United States Patent [19]

Graves

[11] Patent Number: 4,960,369

[45] Date of Patent: Oct. 2, 1990

[54] ROTATABLY DRIVEN POSITIVE DISPLACEMENT PUMP

[76] Inventor: John G. Graves, 3107 Woodward Blvd., Tulsa, Okla. 74105

[21] Appl. No.: 371,258

[22] Filed: Jun. 26, 1989

[51] Int. Cl.[5] ..... F04B 3/00; F04B 9/04

[52] U.S. Cl. ..... 417/536; 417/535; 417/534; 417/434

[58] Field of Search ..... 417/500, 534, 535, 536, 417/537, 434, 448, 449

[56] References Cited

U.S. PATENT DOCUMENTS

| | | | |
|---|---|---|---|
| 2,245,457 | 6/1940 | Brassell | 74/57 |
| 2,470,888 | 10/1944 | Degner | 74/57 |
| 2,612,312 | 11/1944 | Clarke | 417/538 X |
| 3,036,810 | 8/1957 | Conrad et al. | 74/57 X |
| 3,061,175 | 10/1962 | Schmidt | 417/434 |
| 3,388,603 | 12/1965 | Clark | 74/57 |
| 4,362,478 | 12/1982 | Huckaby | 417/434 |
| 4,479,759 | 10/1984 | Zeitz | 417/500 |
| 4,854,837 | 8/1989 | Cordray | 417/500 |

FOREIGN PATENT DOCUMENTS

| | | | |
|---|---|---|---|
| 320630 | 10/1929 | United Kingdom | 417/500 |

*Primary Examiner*—John Rivell

[57] ABSTRACT

A rotatably driven positive displacement pump including a tubular conduit with a barrel communicating therewith, the barrel having a plurality of pairs of spaced apart fluid inlet and fluid outlet ports, each port being controlled by a unidirectional valve, a piston reciprocally supported within the barrel between each pair of inlet and outlet ports, each piston being tubular and having a continuous substantially sinusoidal wave-shaped groove in the interior surface and a groove in the exterior surface in a plane of the piston cylindrical axis, a pin extending from the side wall for each piston and into the exterior groove to permit axial displacement, but limiting the rotation of the piston, a drive shaft rotatably received within the barrel and within each piston opening and a crank member affixed to the drive shaft for each piston and extending within the wave-shaped groove in the internal surface of the piston so that as the crank shaft is rotated, the pistons are axially displaced within the barrel and are displaced in a sequence wherein adjacent pistons alternately move towards and away from each other whereby fluid is pumped into the inlet ports between pairs of pistons as the pistons move away from each other and out the outlet ports between pairs of pistons as the pistons move towards each other.

6 Claims, 2 Drawing Sheets

ROTATABLY DRIVEN POSITIVE DISPLACEMENT PUMP

SUMMARY OF THE INVENTION

Many type of pumps exist for the movement of fluid from one location to another. A particularly difficult type of fluid movement is that of pumping fluid, such as, oil, from a subterranean formation to the earth's surface. This invention will be described as it is particularly adapted to pumping oil in a well, wherein the oil must be moved from within the earth, usually at depths of hundreds or thousands of feet, to the earth's surface, although the invention is by no means limited to this application. The typical well is a borehole in the earth having a string of tubing therein which forms a fluid conduit for moving produced fluid to the earth's surface. The typical oil well in the United States is pumped by reciprocating a string of sucker rods in the tubing. The sucker rods are usually reciprocated by a pumping unit at the earth's surface, and at the bottom of the tubing string there is a positive displacement pump consisting of a barrel and a plaunger moved within the barrel. Upon the upstroke of the pump, fluid is lifted to the earth's surface; and on the downstroke, fluid is permitted to enter the barrel above the piston so that, by reciprocation of the plunger within the barrel, fluid is gradually moved to the earth's surface.

Reciprocating pumps work satisfactorily, however, the equipment necessary to reciprocate a pump in a well is expensive. Such pumping equipment must be sufficiently strong to support and reciprocate a long string of sucker rods. This requires a pumping unit of substantial size for the normal application with counterbalancing and so forth. The present invention is directed towards an apparatus for providing positive displacement forces at the bottom of a tubing string utilizing a rod string, such as a string of sucker rods, which, instead of being reciprocated, is rotated. A tubular barrel is affixed in axial alignment with the lower end of the tubing string in which the tubing string functions as a conduit to conduct fluid from a subterranean formation to the earth's surface. The barrel has a number of pairs of spaced apart fluid inlet and fluid outlet ports. Each inlet port is controlled by a unidirectional fluid inlet valve, and, in like manner, each outlet port is controlled by a unidirectional fluid outlet valve. The barrel provides an internal cylindrical pumping surface.

Positioned within the barrel is a piston between each pairs of inlet and outlet ports. Thus, if there are six inlet and outlet ports there will typically be five pistons, that is, one between each adjacent pairs of ports. Each piston has an axial opening through it, that is, each piston is tubular in basic construction. The outer cylindrical surface provides a pumping surface closely fitting the interior cylindrical surface of the barrel.

Formed on the interior of the axial opening of each piston is a continuous substantially sinusoidal wave-shaped groove. In one embodiment of the invention, at least one groove is formed on each piston external cylindrical surface and the external groove is in a plane of the piston cylindrical axis. Preferably the external groove does not extend the full length of the piston, that is, the external groove does not communicate with either the top or bottom end of the piston.

A drive shaft is rotatably and non-axially displaceably received in the barrel and within each piston axial opening. The upper end of the drive shaft is secured to the lower end of a sucker rod string or other means whereby the drive shaft may be rotated. A crank arm member is affixed to the drive shaft for each piston and the outer ends of each crank arm extends into the internal wave-shaped groove of its corresponding piston. The wave-shaped groove of adjacent pistons are rotatably displaced from each other.

When the drive shaft is rotated, the crank members move in the internal grooves of each piston causing the piston to be reciprocably axially displaced. The grooves in the pistons are oriented so that the pistons sequentially, as to each adjacent pair, move toward each other and away from each other. As adjacent pairs move toward each other, fluid trapped between the pistons is forced out of the barrel through the outlet port associated with that pair of pistons. At the same time, other pairs of pistons are moving away from each other, and between these pairs of pistons, fluid is drawn into the barrel through the corresponding inlet port. In this way fluid is being drawn into the barrel by approximately one-half of the pairs of pistons, and is being expelled from the barrel by approximately the other half of the pairs of pistons. The expelled fluid is communicated to the tubing string, and is thereby moved to the earth's surface.

In an alternate embodiment, the groove in the external surface of each piston is also sinusoidal, but at a different frequency than that of the internal sinusoidal groove. This permits the piston to rotate, but at the same time be axially displaced as the drive shaft is rotated.

An additional feature of the invention is a means of draining the fluid within the tubing string when it is necessary to pull the tubing string from a well. For this purpose a drainage port is provided in the barrel adjacent the point of attachment to the tubing string. The drainage port is closed by a closure member having a trip portion extending from it. The tubing string is telescopically attached to the drive shaft. The tubing string may thereby be lowered relative to the drive shaft, so that the end of the tubing string engages the trip member opening the clapper member, thereby opening the drainage port and permitting fluid in the tubing string above the port to be drained back into the well exteriorally of the tubing.

A better understanding of the invention will be had by reference to the following description and claims taken in connection with the attached drawings.

DESCRIPTION OF THE PREFERRED EMBODIMENT

Figure 1:
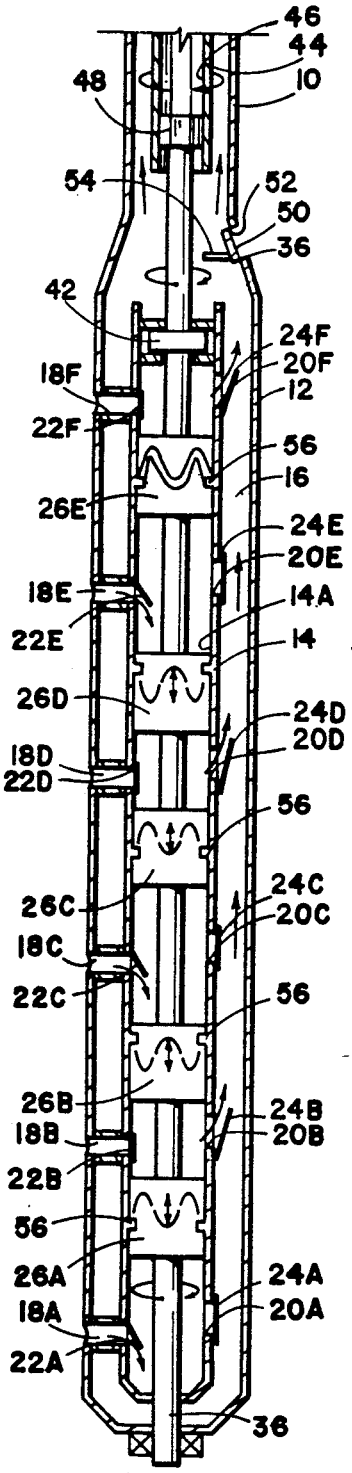
FIG. 1 is an elevational cross-sectional view of a diagrammatic representation of a pump employing the principles of this invention. The pump illustrated is that of the type for use in pumping fluid from an oil well.

Referring to the drawing and first to FIG. 1, an application of the principles of this invention is shown for use in a bottom hole pump, such as for pumping an oil well. A tubular string 10 extends to the earth's surface (not shown) and forms a conduit for conducting fluid from a subterranean formation to the earth'surface. At the lower end of tubing string 10 is a tubular housing 12 forming a portion of the pump. Within tubular housing 12 is a tubular barrel 14. The barrel is supported so that it is non-axially displaceable within tubular housing 12 with respect to tubing string 10. Exteriorally of barrel 14 and interiorally of housing 12 is an annular area 16 which communicates with the lower end of tubing string 10.

Formed in the barrel 14 are a plurality of pairs of inlet and outlet ports, there being six such pairs shown in FIG. 1. The inlet ports are identified by numerals 18A–18F. The inlet ports communicate between the interior of barrel 14 and the exterior of housing 12. Each pair of ports is matched by a pair of outlet ports, thus there are outlet ports 20A–20F. For each inlet port there is a unidirectional inlet valve, thus there are valves 22A–22F. In like manner, for each of the outlet ports 20A–20F there is an outlet valve indicated as 24A–24F. Outlet ports 20A–20F communicate from the interior of barrel 14 to the annular area 16.

Figure 2:
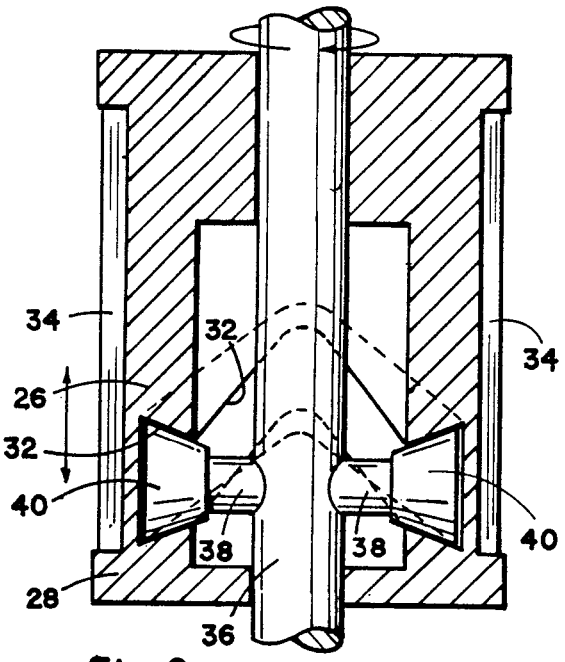
FIG. 2 is an enlarged cross-sectional view of a piston and a segment of the drive shaft within the piston as employed in the pump of FIG. 1, and showing the drive shaft in one relative orientation with respect to the piston.
Figure 3:
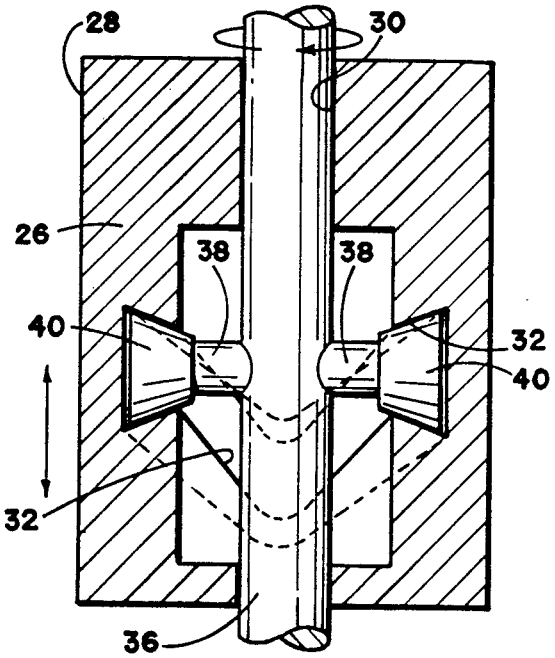
FIG. 3 is a cross-sectional view of a piston as in FIG. 2, showing the piston in a different orientation with respect to the drive shaft.

Spaced between each pair of ports is a piston, there being five pistons in FIG. 1 indicated as 26A–26E. Note that, as an example, piston 26A is and always remains between first ports 18A and 20A and second ports 18B and 20B. Each of the other pistons likewise is associated with upper and lower pairs of inlet and outlet ports. Each piston is cylindrical on its exterior surface, as best seen in FIGS. 2 and 3. The exterior surface being identified by the numeral 28. The exterior surface 28 of each piston closely but slideably conforms to the interior cylindrical surface 14A of barrel 14.

Figure 4:
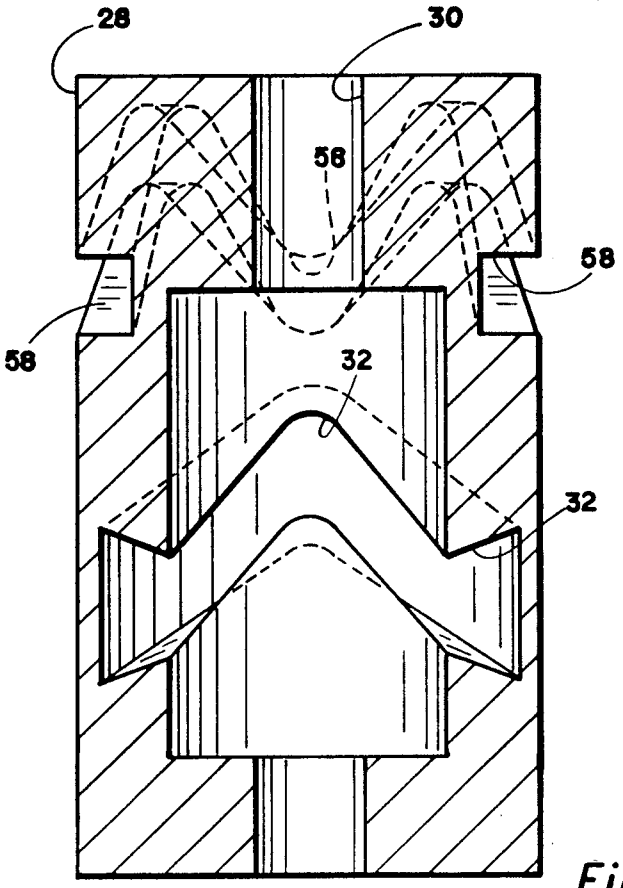
FIG. 4 is an elevational cross-sectional view of a piston showing an alternate embodiment of the invention wherein the piston has a second continuous substantially sinusoidal wave-shaped groove in the exterior surface.

As shown in FIGS. 3 and 4, each of the pistons has a cylindrical opening 30 therethrough. Thus, each of the pistons is, in a manner of speaking, tubular. Formed in the cylindrical opening of each piston is a continuous, substantially sinusoidal wave-shaped groove 32. The layout of such continuous groove 32 is shown in the bottom portion of FIG. 5.

In one embodiment of the invention, each piston 26 is supported in a non-rotatable, but axially displaceable, relationship with barrel 14. For this purpose, there is formed at least one groove 34 in the barrel external surface 28. In the embodiment illustrated in FIG. 2, there are two such external grooves 34 spaced 180° apart from each other on the piston external cylindrical surface 28. The length of each groove 34 is preferably less than the length of the piston, that is, each groove preferably does not extend the full length of the piston so that at least a part of the piston has an uninterrupted cylindrical external surface.

In FIG. 3, the piston 26 is shown rotated 90° relative to the view of FIG. 2. This is so even though as previously indicated in the preferred embodiment, the piston itself is not permitted to rotate, but such is shown only for effectiveness of illustration.

Received within barrel 14 is a drive shaft 36. This drive shaft is of an external diameter slightly less than that of the cylindrical opening 30 of each of the pistons. Extending from the drive shaft at a point where it passes through each of the pistons is a crank member 38. In the arrangement illustrated in FIGS. 2 and 3, crank member 38 extends as a pin passing through the drive shaft 36 so that it extends in both directions from the drive shaft external surface. The outer ends of the crank member 38 extend within the internal wave-shaped groove 32. In the prefered arrangement as illustrated in FIGS. 2 and 3, the wave-shaped groove is in cross-section showing a dove-tailed configuration. In like manner, the outer ends 40 of the crank member 38 are in a dove-tailed shape, and these outer ends may be supported in a bearing arrangement with respect to the crank member 38.

The drive shaft 36 is rotatably, but non-axially, displaceably supported relative to the barrel 14, and this is illustrated by a thrust and radial load bearing 42. Such a bearing can also be positioned between the drive shaft and housing 12, rather than with the barrel 14, if desired, and more than one thrust and radial load bearing may be employed.

The upper end of the drive shaft 36 is secured to the lower end of a rod string 44. In the illustrated arrangement of FIG. 1, the lower end of the rod string 44 has a longitudinal opening 46 therein which is of non-circular internal cross-sectional configuration. Received in this non-circular opening, which may be, as an example, hexagonal in cross-sectional configuration, is a slide member 48 having a mating external cross-sectional configuration so that the lower end 44 of a rod string is telescopically, but non-rotatably, interconnected to the upper end of the drive shaft 36. This permits the rod string to be pulled from the interior of the tubular string 10 independently of removing the tubular string.

When it is necessary to service the pump unit of FIG. 1, the tubular string 10 must be removed. This is normally accomplished by removing sequential lengths of the tubular string at the earth's surface. When the pump is not in action, all of the outlet valves 24A–24F are closed, thereby retaining fluid within the tubular string 10. To eliminate contending with this column of fluid as the tubular string is pulled, provision is made for draining fluid from the tubular string when it is necessary to pull it. For this purpose, a drain port 50 is formed in the upper end of the tubular housing 12. The drain port is normally closed by a drain port valve 52 so that as fluid is pumped it remains within the confines of the tubular housing 12 and tubular string 10 to thereby be conveyed to the earth's surface. Extending from the drain port valve 52 is a trip member 54. When the trip member is engaged, such as by downwardly telescopically lowering the tubing string 44, the drain port valve 52 is opened, allowing fluid within the tubular string 10 to drain back into the subterranean formation.

The pump of FIG. 1 is operated in the following manner. With the rod string 44 continuously rotated in a selected direction, the drive shaft 36 is likewise continuously rotated in the same direction. The orientation of the wave-shaped grooves 32 in adjacent pistons is out of phase with each other so that as the drive shaft 36 is rotated the pistons 26A–26E are sequentially axially displaced in an upwardly and downwardly direction within the barrel 14. The displacement takes place in a manner so that with respect to adjacent pairs of pistons the movement of the pistons are in opposite directions, that is, for example, piston 26A moves in a direction opposite of piston 26B. This causes pistons 26A and 26B to sequentially move towards and away from each other. When pistons 26A and 26B move toward each other, fluid confined within the interior of barrel 14 between these pistons is compressed, thereby opening outlet valve 24B and causing the fluid within the barrel between pistons 26A and 26B to be expelled into the annual area 16. During this time, the inlet valve 22B is closed.

At the same time, pistons 26B and 26C are moving away from each other. This causes an expanding area interiorly of the barrel between these two pistons, causing reduced fluid pressure which causes the inlet valve 22C to open. This permits fluid to pass through inlet port 18C into the interior of the barrel. This sequence of alternately expanding and compressing areas within the cylinder between adjacent pairs of pistons is continuously repeated as the pistons sequentially displace upwardly and downwardly. In this arrangement, fluid is, during most of the period of revolution of drive shaft 36, being drawn into barrel 14 and simultaneously expelled from barrel 14, thereby creating a substantially constant rotational load. This result is very important as it not only equalizes torque and power requirements, but it also virtually eliminates differential stretch and contraction of rod string.

In order to maintain each of the pistons in a reciprocal but non-rotatable relationship, there is, for each piston extending from the interior wall 14B of the barrel, a piston guide member 56. In the arrangement of FIG. 1, the two opposed piston guide members 56 are employed for each piston to engage the opposed grooves 34, although it can be seen that only one groove is required for each piston which would thereby employ only one piston guide means 56. The piston guide means 56 are in the form of a key member, and in the arrangements of FIGS. 1, 2 and 3 such member 56 may be only a short length circular element.

Figure 5:
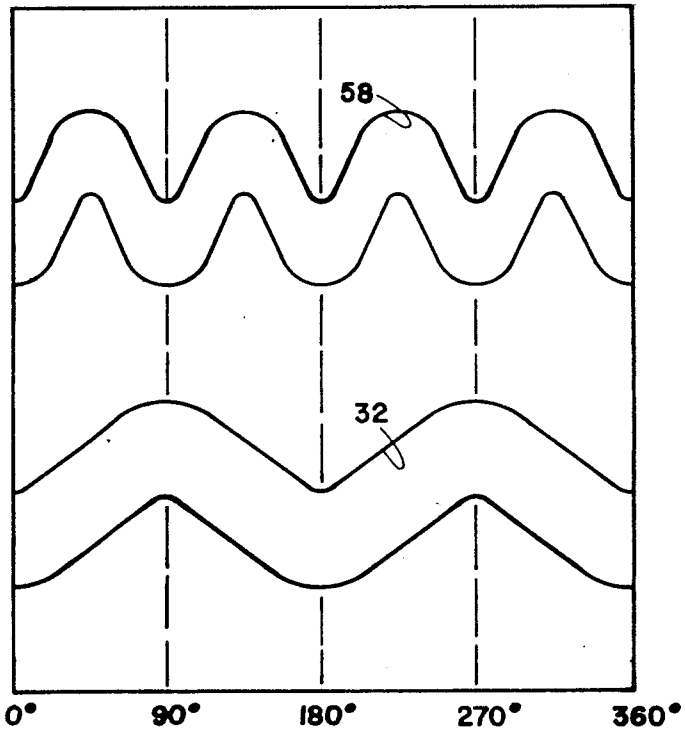
FIG. 5 is a layout representing the exterior and interior grooves in the piston of FIG. 4, showing the relative relationship of the grooves.

FIG. 4, taken in conjunction with FIG. 5, shows an alternate embodiment of the invention. In FIG. 4, a single piston 26F is illustrated. The basic piston including the cylindrical opening 30 and the wave-shaped substantially sinusoidal continuous wave groove 30 is of dove-tail, cross-sectional configuration as described with reference to FIGS. 2 and 3. However, unlike the arrangement of FIGS. 2 and 3, instead of a linear external groove in the piston external surface 28, there is provided a continuous substantially sinusoidal wave groove 58. The external groove 58 is out of register with the internal groove 30 in the embodiment of FIG. 4, and, in addition, may, as illustrated, be of a different period or frequency.

FIG. 5 shows the layout of both the internal groove 32 and external groove 58, showing the difference in period or frequency of the external groove 58 and relative to the internal groove 32. The arrangement of FIG. 4 causes the piston 26F to be not only axially displaced, but also rotated in response to the rotation of shaft 36. The piston 26F rotates at a lower rpm than that of shaft 30 so that it both simultaneously rotates and displaces. The provision of simultaneously limited rotation of the piston of FIG. 4 is obtained at the sacrifice of some of the axial displacement which would ordinarily be accomplished by the internal groove 30 if the piston did not rotate. It, however, has the advantage of reducing wear on the piston; that is, the wear on the piston external surface 28 is more evenly distributed over the entire external surface of the piston because of the rotation thereof than is achieved with the embodiment of FIGS. 1–3 where the pistons are axially displaced but not rotated.

The positive displacement pump of this invention has advantages previously referred to over the typical reciprocating positive displacement pump commonly utilized in the petroleum industry. A major advantage is the substantially constant load placed on the pump without the need of heavy equipment or counterbalancing so that fluid is produced at a more constant rate of flow rather than as a pulsed flow as is obtained with a reciprocating type pump, even though the fluid pumping action is achieved by positive displacement. Thus, the pump of this invention is not speed dependent—that is, it can be rotated as slow as desired to accommodate to the volume of fluid production of the oil well in which the pump is used.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A rotationally driven positive displacement pump, comprising:

a tubular conduit;

a barrel affixed in axial alignment with one end of said conduit, the barrel having a plurality of pairs of spaced apart fluid inlet and fluid outlet ports, each inlet port being controlled by an unidirectional fluid inlet valve and each outlet port being controlled by an unidirectional fluid outlet valve, the barrel providing an internal cylindrical surface;

a plurality of pistons reciprocally supported within said barrel, there being a piston between each pair of inlet and outlet ports, each piston having an axial opening therethrough and having a continuous substantially sinusoidal wave-shaped groove in the internal surface of said axial openings;

chamber means communicating said barrel fluid outlet ports with said tubular conduit, said barrel fluid inlet ports being exposed to a fluid containing environment;

a drive shaft rotatably and non-axially, displaceably received in said barrel and within each said piston axial openings;

means within said tubular conduit connected to said drive shaft for the rotation thereof;

a crank member affixed to said drive shaft for each said piston, each crank arm extending slideably within said wave-shaped groove in the internal surface of a piston, the wave-shaped grooves of adjacent pistons being rotationally displaced for each other relative to the corresponding crank members; and means to limit the rotation of each of said pistons whereby the rotation of said drive shafts causes said pistons to axially displace relative to said barrel and relative to each other whereby when adjacent pistons move away from each other fluid is drawn through the appropriate inlet port into said barrel, and when said pistons move toward each other, fluid is displaced from with said barrel through said appropriate outlet port.

2. A rotationally driven positive displacement pump according to claim 1 wherein said means to limit the rotation of each of said pistons includes at least one groove in the exterior cylindrical surface of said pistons; and pin means extending from said barrel interior wall and sideably received in each of said piston exterior grooves.

3. A rotationally driven positive displacement pump according to claim 2 wherein said at least one groove in said piston exterior cylindrical surface is substantially linear and substantially in a plane of the piston cylindrical axis.

4. A rotationally driven positive displacement pump according to claim 2 wherein said at least one groove in each of said exterior cylindrical surface of each said piston is a continuous, substantially sinusoidal wave-shaped groove and of a period different from that of said substantially sinusoidal wave-shaped groove in the interior surface of said axial opening in each said piston.

5. A rotationally driven positive displacement pump according to claim 1 wherein said substantially sinusoidal wave-shaped groove in said internal cylindrical surface of said axial opening of each said piston is dove-tail shape in cross-section and wherein each said crank member is of mating dove-tail shape configuration.

6. A rotationally driven positive displacement pump according to claim 1 wherein said tubular conduit is substantially vertical, such as a tubing string in an oil well, and including:

a drainage port in said barrel;

a clapper member normally closing said drainage port;

a rotatable rod string within said tubular conduit and telescopically attached to said drive shaft and providing said means to rotate said drive shaft; and means to open said closure member upon the axial displacement of said rod string.

* * * * *